US008016077B2

(12) United States Patent
Astor et al.

(10) Patent No.: US 8,016,077 B2
(45) Date of Patent: Sep. 13, 2011

(54) CLIP FOR TRANSPORTATION OF LADDERS AND METHOD

(75) Inventors: Kyle G. Astor, Conneaut Lake, PA (US); Shannon Brightbill, Hermitage, PA (US); Brian Fisher, Greenville, PA (US); Joseph Dangrow, Fredonia, PA (US)

(73) Assignee: Werner Co., Greenville, PA (US)

( * ) Notice: Subject to any disclaimer, the term of this patent is extended or adjusted under 35 U.S.C. 154(b) by 0 days.

(21) Appl. No.: 12/380,296

(22) Filed: Feb. 26, 2009

(65) Prior Publication Data

US 2009/0165267 A1 Jul. 2, 2009

Related U.S. Application Data

(62) Division of application No. 11/212,944, filed on Aug. 27, 2005, now Pat. No. 7,743,887.

(51) Int. Cl.
*E06C 1/10* (2006.01)

(52) U.S. Cl. ..... 182/129; 182/127

(58) Field of Classification Search ..... 182/129
See application file for complete search history.

(56) References Cited

U.S. PATENT DOCUMENTS

| | | | | | |
|---|---|---|---|---|---|
| 3,283,972 | A | * | 11/1966 | Kocina | 224/318 |
| 3,654,383 | A | * | 4/1972 | Wilson | 174/163 F |
| 4,984,721 | A | * | 1/1991 | Eiley et al. | 223/96 |
| 5,075,935 | A | * | 12/1991 | Abdi | 24/511 |
| 5,161,909 | A | | 11/1992 | Crouse et al. | |
| 5,297,889 | A | * | 3/1994 | Crouse et al. | 403/391 |
| 2008/0006479 | A1 | * | 1/2008 | Mabry | 182/18 |

* cited by examiner

*Primary Examiner* — Alvin C Chin-Shue
(74) *Attorney, Agent, or Firm* — Ansel M. Schwartz

(57) ABSTRACT

A clip for maintaining a first side rail of a first ladder adjacent to a second side rail of a second ladder which is in series with the first side rail. The clip includes a first portion connected to a support element and a second portion connected to the support element. The first portion, second portion and support element are one continuous piece. The first portion defines a hooking engagement with the first side rail and the second portion defines a receiving engagement with the second side rail. The first and second portion opening from opposite sides of the support element, respectively, which conform to the portion of the respective side rail that it receives for removably and frictionally holding the respective side rails in a self-gripping and form-fitting manner such that the side rails are maintained adjacent and in series to each other so that no damage is possible to the ladders by relative movement of the side rails under dynamic conditions brought about by motion during transportation. A method for securely transporting a first ladder which defines a first plane for climbing and at least a second ladder which defines a second plane for climbing.

3 Claims, 4 Drawing Sheets

CLIP FOR TRANSPORTATION OF LADDERS AND METHOD

CROSS-REFERENCE TO RELATED APPLICATIONS

This is a divisional application of U.S. patent application Ser. No. 11/212,944 filed Aug. 27, 2005 now U.S. Pat. No. 7,743,887.

FIELD OF THE INVENTION

The present invention is related to a clip that maintains two ladders together during transportation. More specifically, the present invention is related to a clip that maintains two ladders adjacent and in series to each other so that no damage is possible to the ladders by relative movement of their side rails under dynamic conditions brought about by motion during transportation.

BACKGROUND OF THE INVENTION

When ladders are shipped from the manufacturing site for distribution, they commonly are bundled together. During the transportation process, the ladders can be jarred and moved about relative to each other which sometimes results in components of the ladder, such as the safety shoes, damaging other ladders to which they are bundled. Furthermore, this relative movement sometimes causes the banding that is used to hold the ladders together to become loosened and cardboard that is used to wrap around the ladders to be crushed. Accordingly, it is desirable to maintain the ladders as still as possible relative to each other during shipment.

SUMMARY OF THE INVENTION

The present invention pertains to a clip for maintaining a first side rail of a first ladder adjacent to a second side rail of a second ladder which is in series with the first side rail. The clip comprises a first portion connected to a support element and a second portion connected to the support element. The first portion, second portion and support element are one continuous piece. The first portion defines a hooking engagement with the first side rail and the second portion defines a receiving engagement with the second side rail. The first and second portion opening from opposite sides of the support element, respectively, which conform to the portion of the respective side rail that it receives for removably and frictionally holding the respective side rails in a self-gripping and form-fitting manner such that the side rails are maintained adjacent and in series to each other so that no damage is possible to the ladders by relative movement of the side rails under dynamic conditions brought about by motion during transportation.

The present invention pertains to a method for securely transporting a first ladder which defines a first plane for climbing and at least a second ladder which defines a second plane for climbing. The method comprises the steps of inserting a first side rail of the first ladder into a first portion of a clip such that the first side rail of the first ladder is removably held thereby and a second portion of the first clip extends from the first side rail essentially perpendicular to the climbing plane of the ladder. There is the step of inserting a second side rail of a second ladder into the second portion of the clip such that the second side rail of the second ladder is removably held thereby. The second portion and the first portion of the clip having a common support element. The first portion defines a hooking engagement with the first side rail and said second portion defines a receiving engagement with the second side rail. The first and second portion opening from opposite sides of the support element, respectively, which conform to the portion of the respective side rail that it receives for removably and frictionally holding the respective side rails in a self-gripping and form-fitting manner. There is the step of moving the ladders, with the clip holding and maintaining the first and second rails adjacent to each other so that no damage is possible to the ladders by relative movement of the rails and the ladders are maintained adjacent each other while the ladders are being transported.

BRIEF DESCRIPTION OF THE DRAWINGS

In the accompanying drawings, the preferred embodiment of the invention and preferred methods of practicing the invention are illustrated in which.

DETAILED DESCRIPTION

Figure 3:
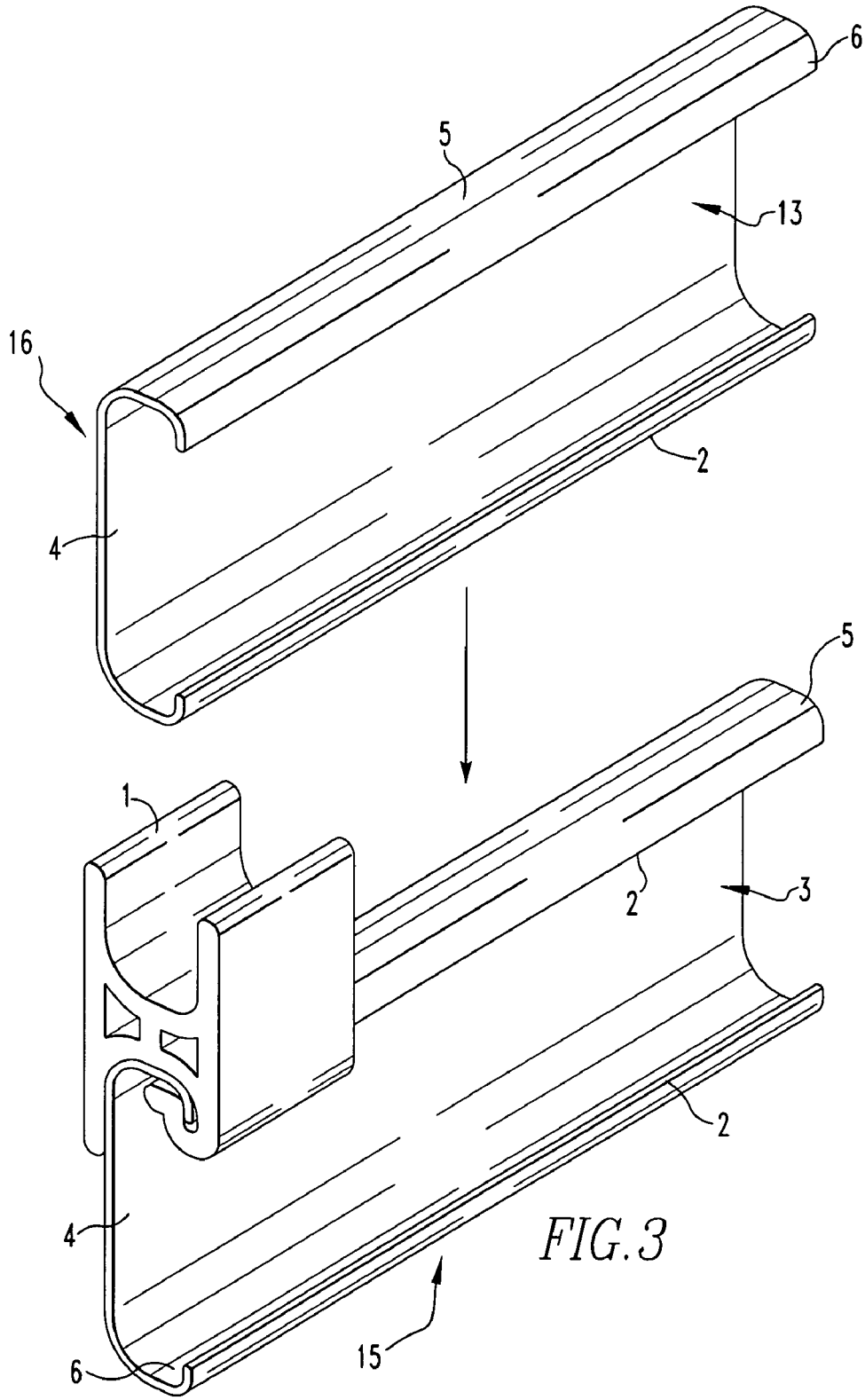
FIG. 3 is a perspective view of a fly of a second side rail of a second ladder being placed into the clip on the first side rail of the first ladder.
Figure 5:
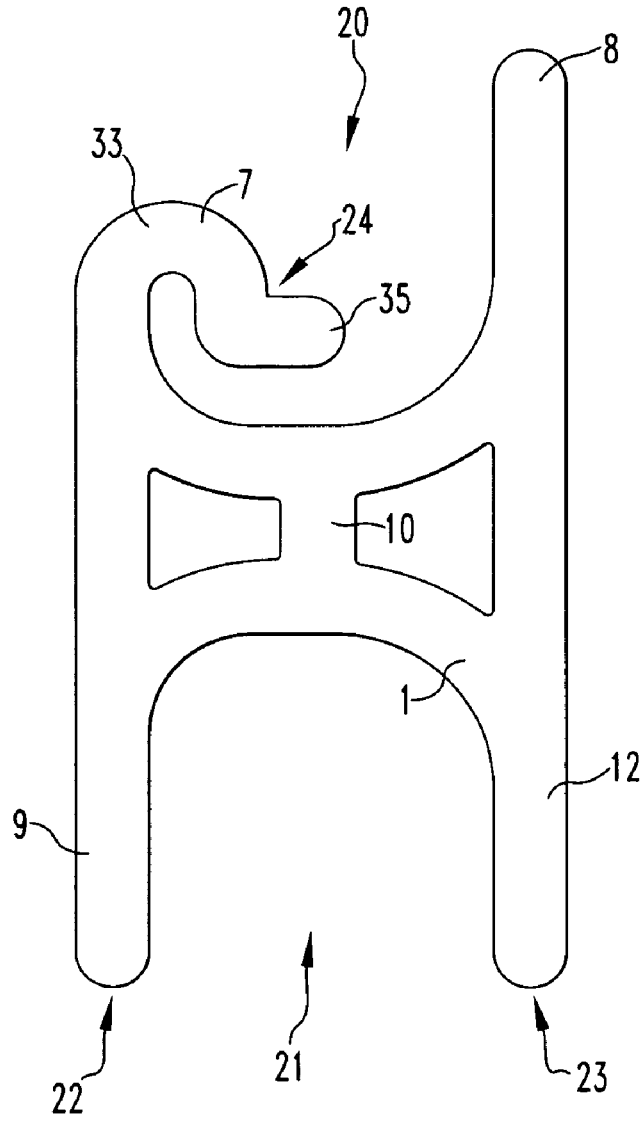
FIG. 5 is a side view of the clip.

Referring now to the drawings wherein like reference numerals refer to similar or identical parts throughout the several views, and more specifically to FIGS. 3 and 5 thereof, there is shown a clip 1 for maintaining a first side rail 3 of a first ladder 15 adjacent to a second side rail 17 of a second ladder 16 which is in series with the first side rail 3. The clip 1 comprises a first portion 20 connected to a support element 10 and a second portion 21 connected to the support element 10. The first portion 20, second portion 21 and support element 10 are one continuous piece. The first portion 20 defines a hooking engagement with the first side rail 3 and the second portion 21 defines a receiving engagement with the second side rail 17. The first and second portion 21 opening from opposite sides of the support element 10, respectively, which conform to the portion of the respective side rail that it receives for removably and frictionally holding the respective side rails in a self-gripping and form-fitting manner such that the side rails are maintained adjacent and in series to each other so that no damage is possible to the ladders by relative movement of the side rails under dynamic conditions brought about by motion during transportation.

The clip 1 preferably includes a first element 22 connected to the support element 10 and a second element 23 connected to the support element 10 with the first element 22 and maintained in spatial relationship from said first element 22 by the support element 10. The first element 22, second element 23 and support element 10 defining the first and second portions 20, 21.

Preferably, the first element 22 and the second element 23 are divided into first, second, third and fourth legs 24, 8, 9, 12, by the support element 10, with the first portion 20 including the first and second legs 24, 8, and the second portion 21 including the third and fourth legs 9, 12. The legs and the support element 10 are preferably formed of molded plastic. Preferably, the first leg 24 has a hook 7. The side rails preferably have curved flanges 5.

The present invention pertains to a method for securely transporting a first ladder 15 which defines a first plane for climbing and at least a second ladder 16 which defines a second plane for climbing. The method comprises the steps of inserting a first side rail 3 of the first ladder 15 into a first portion 20 of a clip 1 such that the first side rail 3 of the first ladder 15 is removably held thereby and a second portion 21 of the first clip 1 extends from the first side rail 3 essentially perpendicular to the climbing plane of the ladder. There is the step of inserting a second side rail 17 of a second ladder 16 into the second portion 21 of the clip 1 such that the second side rail 17 of the second ladder 16 is removably held thereby. The second portion 21 and the first portion 20 of the clip 1 having a common support element 10. The first portion 20 defines a hooking engagement with the first side rail 3 and said second portion 21 defines a receiving engagement with the second side rail 17. The first and second portions 20, 21 opening from opposite sides of the support element 10, respectively, which conform to the portion of the respective side rail that it receives for removably and frictionally holding the respective side rails in a self-gripping and form-fitting manner. There is the step of moving the ladders, with the clip 1 holding and maintaining the first and second rails adjacent to each other so that no damage is possible to the ladders by relative movement of the rails and the ladders are maintained adjacent each other while the ladders are being transported.

Preferably, the first portion 20 includes a first opening for removably receiving the first side rail 3, and the second portion 21 includes a second opening for removably receiving the second side rail 17. Preferably, there is a first element 22 connected to the support element 10 and a second element 23 connected to the support element 10 and maintained in spatial relationship from the first element 22 by the support element 10. The support element 10 preferably maintains the first portion 20 in spatial relationship with the second portion 21.

Preferably, the support element 10 is disposed essentially perpendicular to the first element 22 and second element 23. The first element 22 and the second element 23 are preferably divided into first, second, third and fourth legs 24, 8, 9, 12, by the support element 10, with the first portion 20 including the first and second legs 24, 8, and the second portion 21 including the third and fourth legs 9, 12. Preferably, the first leg 24 has a hook 7. The legs and the support element 10 are preferably one continuous piece formed of molded plastic.

Figure 1:
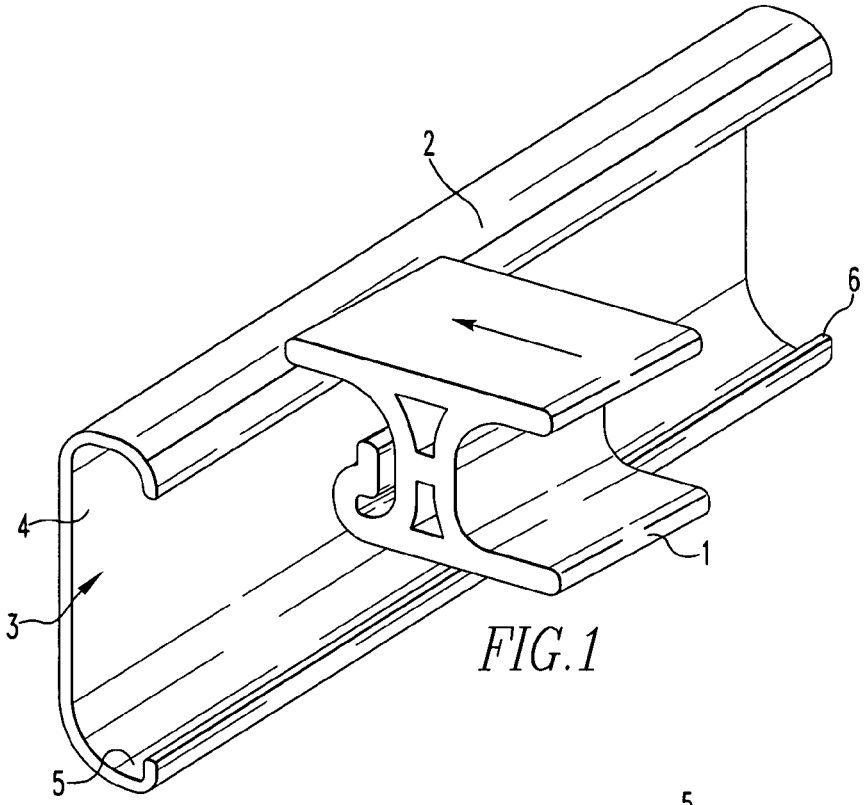
FIG. 1 is a perspective view of a clip of the present invention being placed on a first side rail of a first ladder.

In the operation of the preferred embodiment, the clip 1, as shown in FIG. 1, one is a plastic part used to separate ladders during shipping. The clip 1 can be made to be used on a ladder of any length, width, or side rail geometry. The one piece plastic design fits onto the rail of an extension ladder allowing stacking of base to base and fly to fly.

The purpose of the clip 1 is to eliminate damage during shipment and to enable the shipment of various curved rail profiles. The clip 1 separates the ladders so the safety shoe or other components of the extension ladder do not contact each other. This eliminates the card board crushing and the banding loosening. The clip 1 allows the ladders to be tightly banded throughout the entire shipment. Shipping with the clips 1 greatly reduces movement of the bundle during shipment, thus decreasing the amount of damage that occurs.

The first ladder 15 is placed with the base section facing down and the fly section 2 up. The extension ladders are stacked on pallets or a movable cart at the end of the assembly line.

Figure 2:
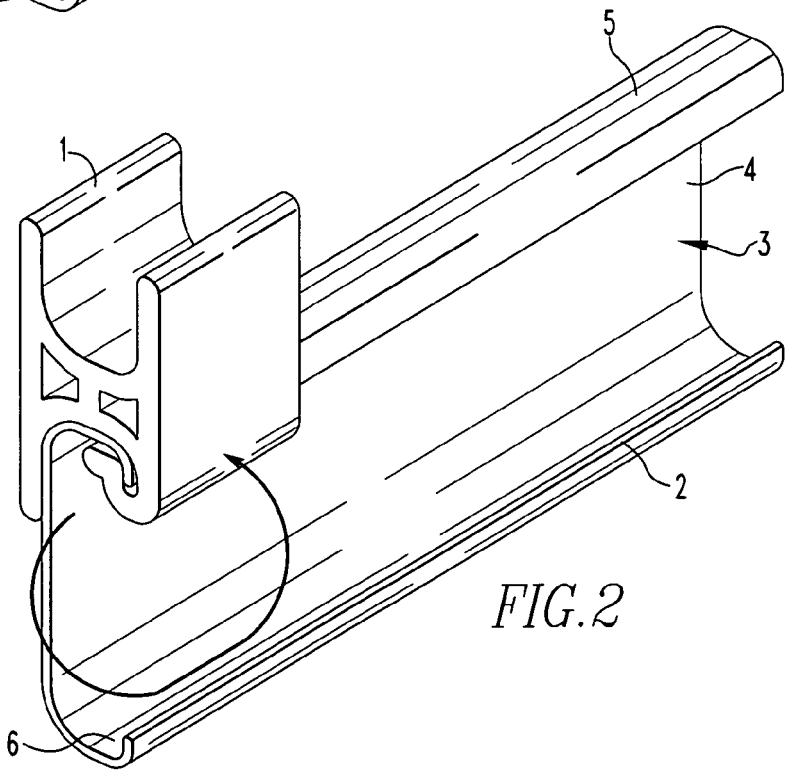
FIG. 2 is a perspective view of the clip being rotated onto a fly of the first side rail of the first ladder.

As shown in FIG. 2, clips 1 are placed on the fly 2 by snapping them over the tips 6 and onto the flange 5 of the first FRP rail 3. This is repeated on all four corners of the fly section 2 for 16 through 24 foot extension ladders. Additional clips 1 are required near the middle of the extension ladders if longer than 24 foot lengths are shipped.

The fly section 2, as shown in FIG. 3, two of the second ladder 16 is then placed on top of clips 1 so that the FRP rail webs 4 are parallel. The base rail 3 of the second FRP extension ladder is now facing up (not shown).

Figure 4:
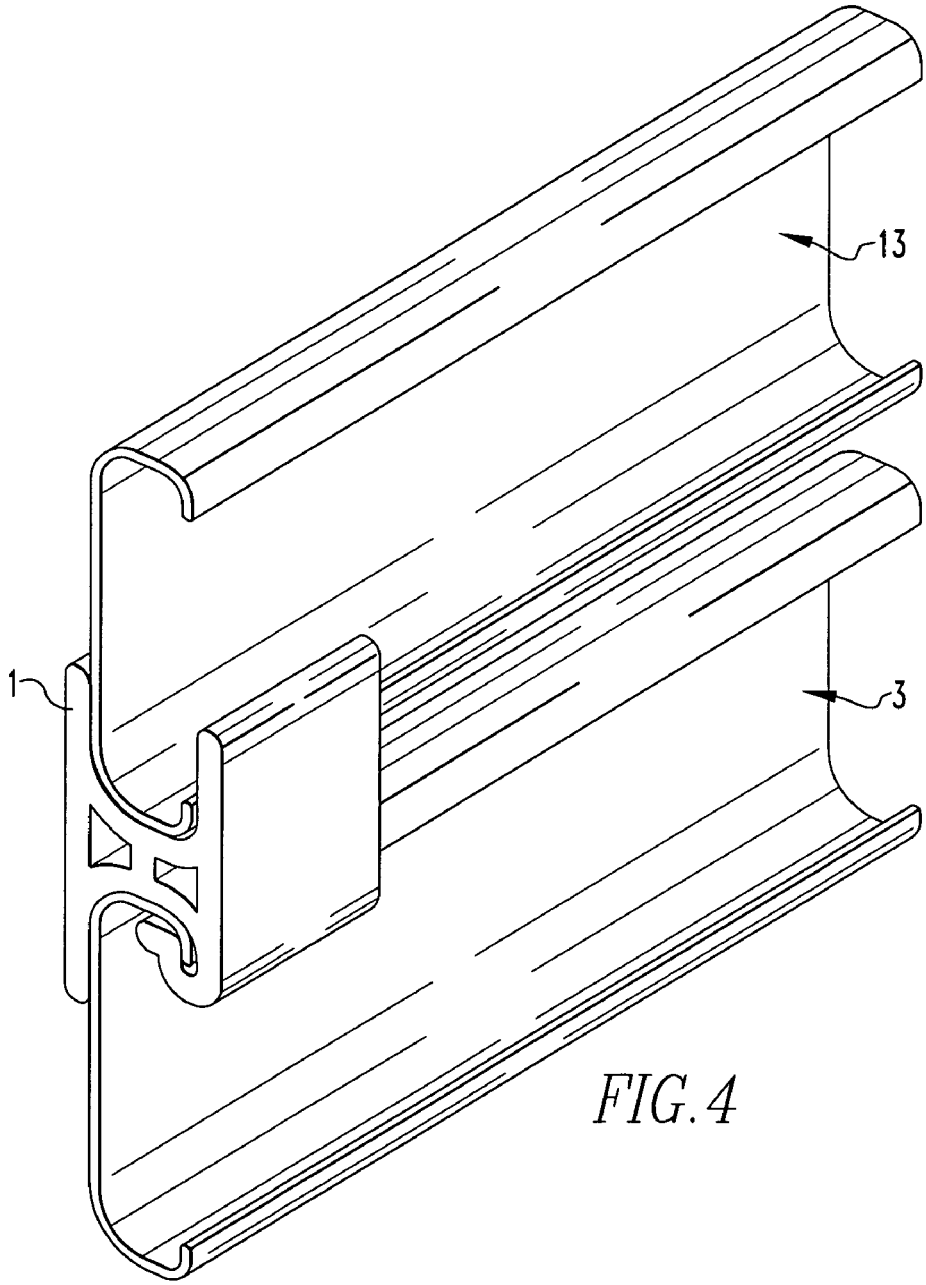
FIG. 4 is a perspective view of the first side rail of the first ladder and the second side rail of the second ladder held in place by the clip.

Four clips 1 now get attached to each of the four corners of the base rail. The next extension ladder is placed base section down interlocking with the clips 1, as shown in FIG. 4. This pattern is continued until the stack of ladders is complete.

The clip 1, as shown in FIG. 5, has features that are built into the overall shape and design of the clip 1. The hook 7 wraps tightly around the first side FRP rail and will stay in place while the operator places the next ladder on the stack. The hook 7 has a first part 33 which is curved toward the support element 10 and a second part 35 which extends from the first part 33 essentially perpendicularly towards a web 4 of the first side rail 3. The spaces created by support element 10 separates the two ladders during shipping to prevent damage caused by rubbing or matting parts coming into contact with one another. The curved shape of the clip 1 fit the shape of the rail to better hold the ladder in place during shipping. The clip 1 has three legs 8, 9, 12 on either end. These legs keep the clip 1 between the two sets of rungs where it is placed. The legs 8, 9, 12 will contact the base or fly 2 rungs and will not travel any further up or down the length of the ladder.

Although the invention has been described in detail in the foregoing embodiments for the purpose of illustration, it is to be understood that such detail is solely for that purpose and that variations can be made therein by those skilled in the art without departing from the spirit and scope of the invention except as it may be described by the following claims.

What is claimed is:

1. A holding system comprising:

a first ladder having a first side C-shaped rail having a web and opposed curved flanges with a tip;

a second ladder having a second C-shaped side rail having a web and opposed curved flanges with a tip; and a clip maintaining the first side rail of the first ladder adjacent to the second side rail of the second ladder which is in series with the first side rail comprising:

a first U shaped portion having a first leg with a hook and a second leg connected to a support element and a second U shaped portion having third and fourth legs connected to the support element, the first portion, the second portion and the support element are one continuous piece, the first portion defining a hooking engagement with the first side rail and the second portion defining a receiving engagement with the second side rail, said first and second portion opening from opposite sides of said support element, respectively, and conform to outer surface of the curved flange of respective side rail that it receives, and removably and frictionally holding the respective side rails in a self-gripping and form-fitting manner such that the respective side rails are maintained adjacent and in series to each other so that no damage is possible to the ladders by relative movement of the respective side rails under dynamic conditions brought about by motion during transportation, the hook has a first part which is curved toward the support element and a second part which is extends from the first part essentially perpendicularly towards a center of the first rail, the hook is adapted to contact and extend along and hold an inner surface of the first side rail flange, a surface of the support element and an inner surface of the first leg form a first curved surface and an inner surface of said first part and second part forms a second curved surface facing the first curved surface, one of the curved flange and tip of the first side rail being matingly, enveloped between the first and second curved surfaces, the legs and the support element are formed of molded plastic.

2. A clip as described in claim 1 wherein said first and third legs defining a first element connected to the support element and said second and fourth legs define a second element connected to the support element with the first element and maintained in spatial relationship from said first element by said support element, said first element, second element and support element defining the first and second portions.

3. A clip as described in claim 2 wherein the first element and the second element are divided into the first, second, third and fourth legs by the support element.

* * * * *